US007293782B2

(12) United States Patent
Jennings et al.

(10) Patent No.: US 7,293,782 B2
(45) Date of Patent: Nov. 13, 2007

(54) CAR MODEL ATTACHMENT FOR STANDARD SKATES

(75) Inventors: Angela L. Jennings, 8180 Chase Way, Arvada, CO (US) 80003; Brent W. Murray, Longmont, CO (US)

(73) Assignee: Angela L. Jennings, Arvada, CO (US)

( * ) Notice: Subject to any disclaimer, the term of this patent is extended or adjusted under 35 U.S.C. 154(b) by 370 days.

(21) Appl. No.: 11/134,485

(22) Filed: May 20, 2005

(65) Prior Publication Data

US 2005/0258629 A1 Nov. 24, 2005

(51) Int. Cl.
*A63C 17/00* (2006.01)

(52) U.S. Cl. ..... 280/11.19; 280/11.3; 280/811

(58) Field of Classification Search ..... 280/11.19, 280/11.3, 811, 1.188; 36/100, 114, 115, 36/132, 136, 71.5
See application file for complete search history.

(56) References Cited

U.S. PATENT DOCUMENTS

| | | | | | |
|---|---|---|---|---|---|
| 1,160,159 | A | * | 11/1915 | Freeman | 280/811 |
| 1,714,760 | A | * | 5/1929 | Bloomberg | 280/811 |
| 1,775,895 | A | * | 9/1930 | Dupuis | 280/11.19 |
| 2,029,787 | A | * | 2/1936 | Ohler | 280/811 |
| 2,171,654 | A | * | 9/1939 | Hinchliff et al. | 36/72 R |
| D232,108 | S | | 7/1974 | Krause | |
| 4,043,241 | A | | 8/1977 | Lui | |
| 4,570,955 | A | | 2/1986 | Winkler et al. | |
| D298,158 | S | | 10/1988 | McKay et al. | |
| D336,972 | S | | 7/1993 | Diaz | |
| 5,311,676 | A | | 5/1994 | Hughes et al. | |
| 5,334,078 | A | * | 8/1994 | Hippely et al. | 446/470 |
| D356,619 | S | | 3/1995 | Shull et al. | |
| D368,356 | S | | 4/1996 | Reale | |
| 5,544,430 | A | | 8/1996 | Jacko | |
| D379,395 | S | | 5/1997 | Aird | |
| D395,479 | S | * | 6/1998 | Gamzo | D21/765 |
| 5,778,564 | A | | 7/1998 | Kettner | |
| 5,845,913 | A | * | 12/1998 | Santarsiero | 280/11.19 |
| 6,047,975 | A | * | 4/2000 | Benoit et al. | 280/11.231 |
| 6,059,062 | A | * | 5/2000 | Staelin et al. | 180/181 |
| D447,320 | S | | 9/2001 | Chute | |
| D459,777 | S | | 7/2002 | Yang | |
| 7,021,663 | B1 | * | 4/2006 | Moran | 280/811 |
| 7,175,187 | B2 | * | 2/2007 | Lyden | 280/11.3 |

* cited by examiner

*Primary Examiner*—Christopher P. Ellis
*Assistant Examiner*—Bridget Avery
(74) *Attorney, Agent, or Firm*—Rick Martin; Patent Law Offices of Rick Martin, P.C

(57) ABSTRACT

A toy car, boat, tank, truck, airplane and the like is made with two inter-connecting parts. The parts fit over a standard skate boot (roller-skate, in-line skate, etc.). Thus a toy is shown having an interconnecting front and rear module, which slips over a standard skate boot. Battery powered lights are shown.

15 Claims, 6 Drawing Sheets

CAR MODEL ATTACHMENT FOR STANDARD SKATES

FIELD OF THE INVENTION

The present invention relates to dressing up standard roller-skates or in-line skates with a car model like a Corvette®. Novel attachment means are shown.

BACKGROUND OF THE INVENTION

Kids love model cars, trucks, trains, airplanes, tanks and the like. Kids also love to skate on roller-skates and in-line skates. But nobody has ever provided the toy market with a means to attach a model car to a standard skate boot.

A brief summary of the known prior art follows below.

U.S. Pat. No. Des 232,108 (1974) to Krause discloses a car shaped roller-skate where the boot of the skate is shaped like a car. The foot slips into the body of the car. The roller wheels are coordinated to look like car wheels.

U.S. Pat. No. Des. 298,158 (1988) to McKay et al. discloses a truck shaped roller-skate where the boot of the skate is shaped like a truck.

U.S. Pat. No. Des. 336,972 (1993) to Diaz discloses a protective cover for shoes.

U.S. Pat. No. Des. 356,619 (1995) to Shull et al. discloses a Walt Disney® amusement ride car.

U.S. Pat. No. Des. 368,356 (1996) to Reale discloses a decorative cover for sneakers.

U.S. Pat. No. Des. 379,395 (1997) to Aird discloses a ride bumper for a skate boot.

U.S. Pat. No. Des. 395,479 (1998) to Gamzo discloses a roller board.

U.S. Pat. No. D447,320 (2001) to Chute discloses a jacket that fits over a shoe.

U.S. Pat. No. D459,777 (2002) to Yang discloses a sneaker with collapsible rollers.

U.S. Pat. No. 1,775,895 (1930) to Dupuis discloses a car shaped roller-skate with a sounder built into the housing.

U.S. Pat No. 4,043,241 (1977) to Liu discloses a musical shoe.

U.S. Pat. No. 5,311,676 (1994) discloses a changeable shoe covering.

U.S. Pat. No. 5,544,430 (1996) to Jacko discloses an athletic shoe cover.

U.S. Pat. No. 5,778,564 (1998) to Ketter discloses a removable cover for a shoe.

U.S. Pat. No. 4,570,955 (1986) Winkler et al. discloses a roller-skate with an interchangeable body looking like various cars. A light is included. Four nuts and bolts secure the assembly together. A custom skate frame is required to attach the car body model to the skate.

Winkler captures the idea of combining a model car to a roller-skate. He even teaches battery-operated lights on his invention. However, he requires a custom skate frame to execute his invention.

What is needed is a snap on means to removably place a model car or the like on a standard skate boot. The present invention provides two designs for attaching a model car to any standard skate boot.

SUMMARY OF THE INVENTION

The main aspect of the present invention is to provide a model car and the like with a two-piece construction, wherein the pieces can be connected around a skate boot.

Other aspects of this invention will appear from the following description and appended claims, reference being made to the accompanying drawings forming a part of this specification wherein like reference characters designate corresponding parts in the several views.

Two embodiments of a model car are disclosed herein. The preferred embodiment has a front-end assembly with sides and rear fenders cast from a single mold. The rear bumper assembly is cast from a second mold. The rear bumper assembly has a left and a right extension rod that engages a left and a right hollowed beam in the front end assembly. A pair of rubber bands keep the extension rods and bumper assembly pulling against the user's boot heel for a snug custom fit for various sized boots.

Another embodiment has the rear bumper assembly hinged to one side of the rear fenders to provide a swinging door type closure in the user's boot heel. Optional powered lights are shown.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

Figure 1:
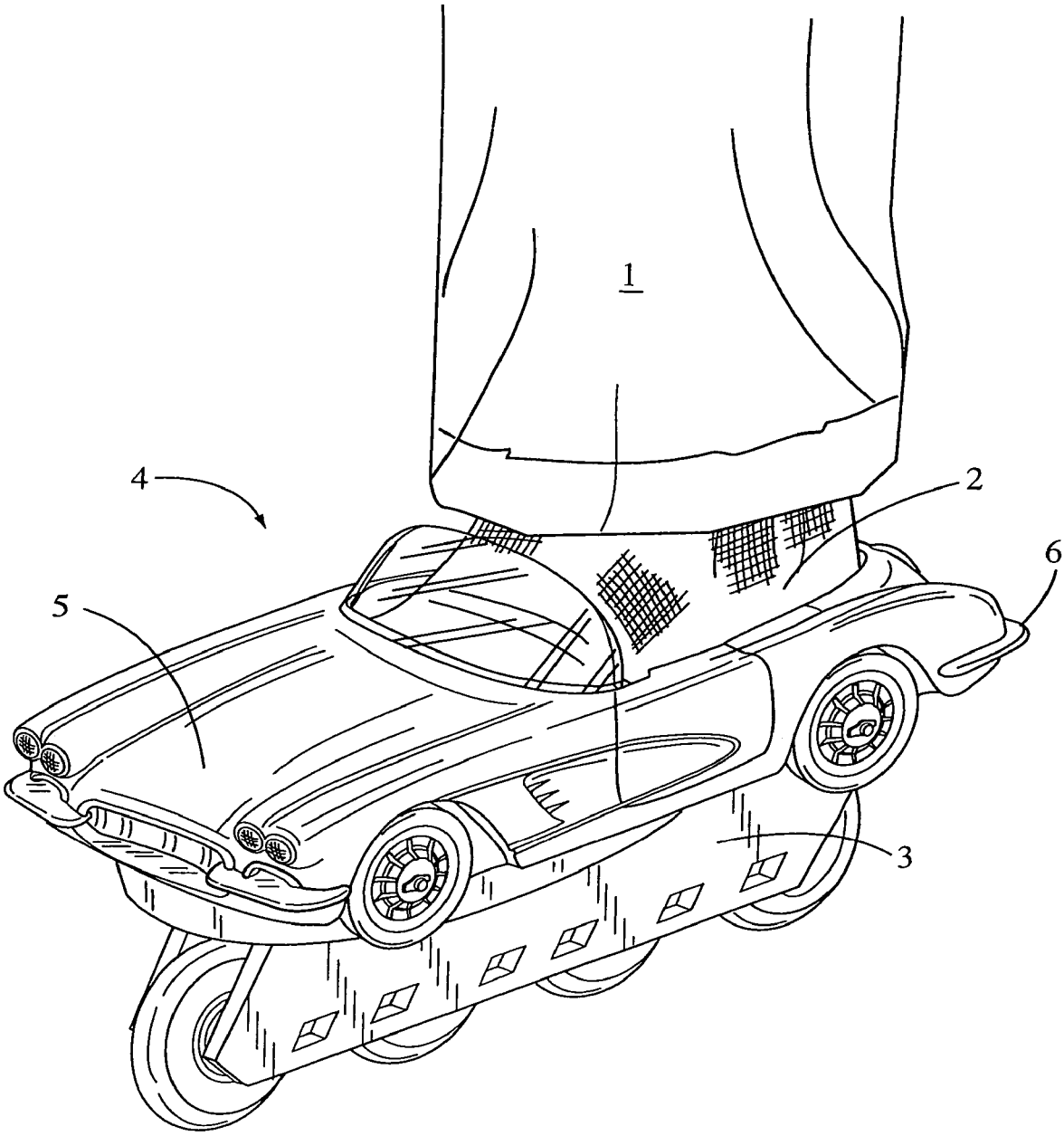
FIG. 1 is a top perspective view of an assembled model car mounted to a standard in-line skate boot.

Referring first to FIG. 1 a skater 1 has a standard boot 2 for an in-line skate 3. A skate car 4 consists of a front module 5 and rear module 6. The term skate car does not limit the scope of this invention to model cars. Any two-part toy model is encompassed by the invention.

Figure 2:
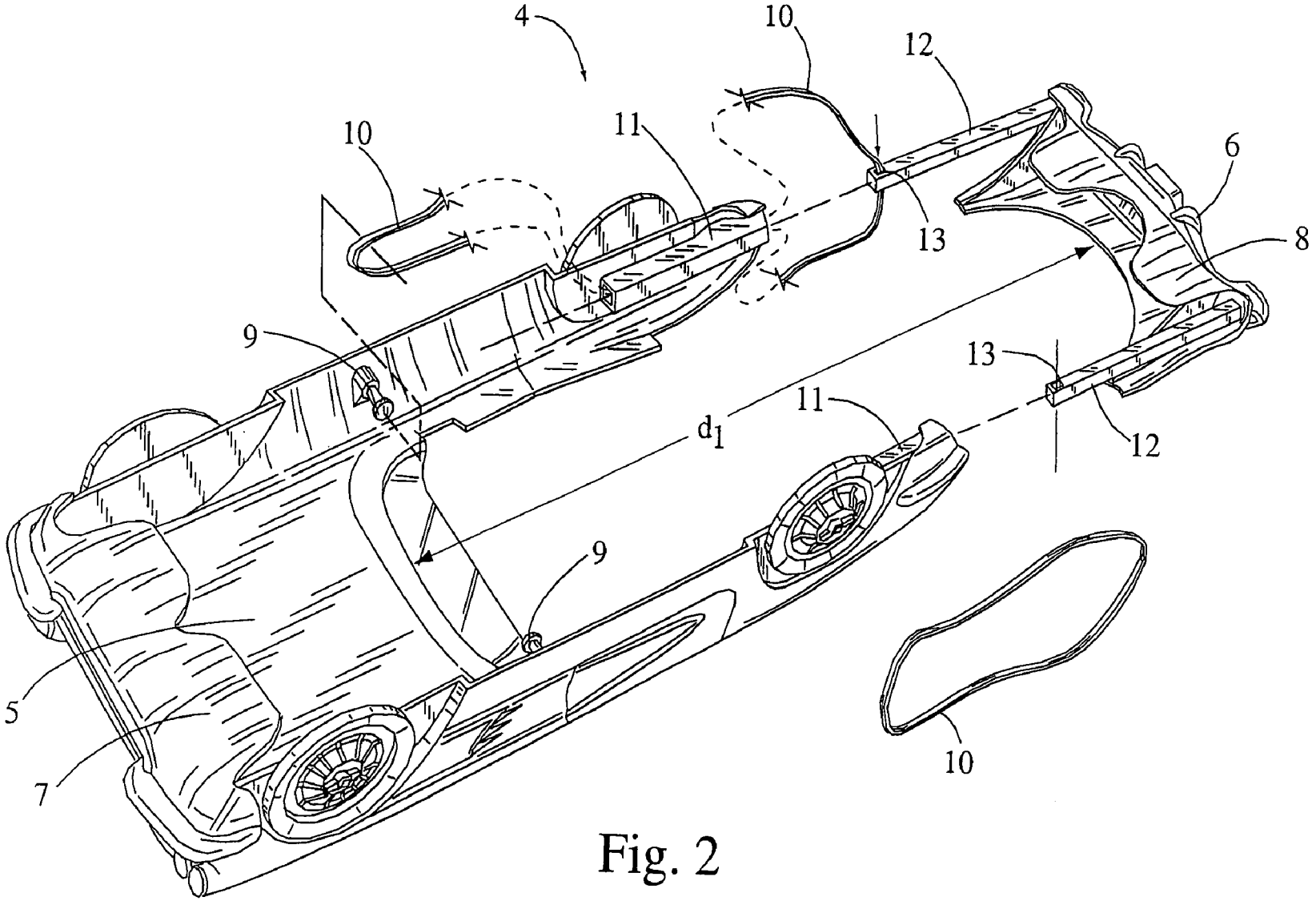
FIG. 2 is a bottom, perspective exploded view of the preferred embodiment skate car.

FIG. 2 shows that the front module 5 has a ledge 7 that fits under the toe of the boot 2. The rear module 6 has a ledge 8 that fits under the heel of the boots 2. The skate car 4 is designed to accommodate a range of boot sizes by varying the boot opening distance d1. The rods 12 slide in the tubes 11. The rubber bands 10 are mounted inside the tubes 11 and then looped over posts 9. Posts 12 have holes 13 to receive the rubber bands 10.

Figure 3:
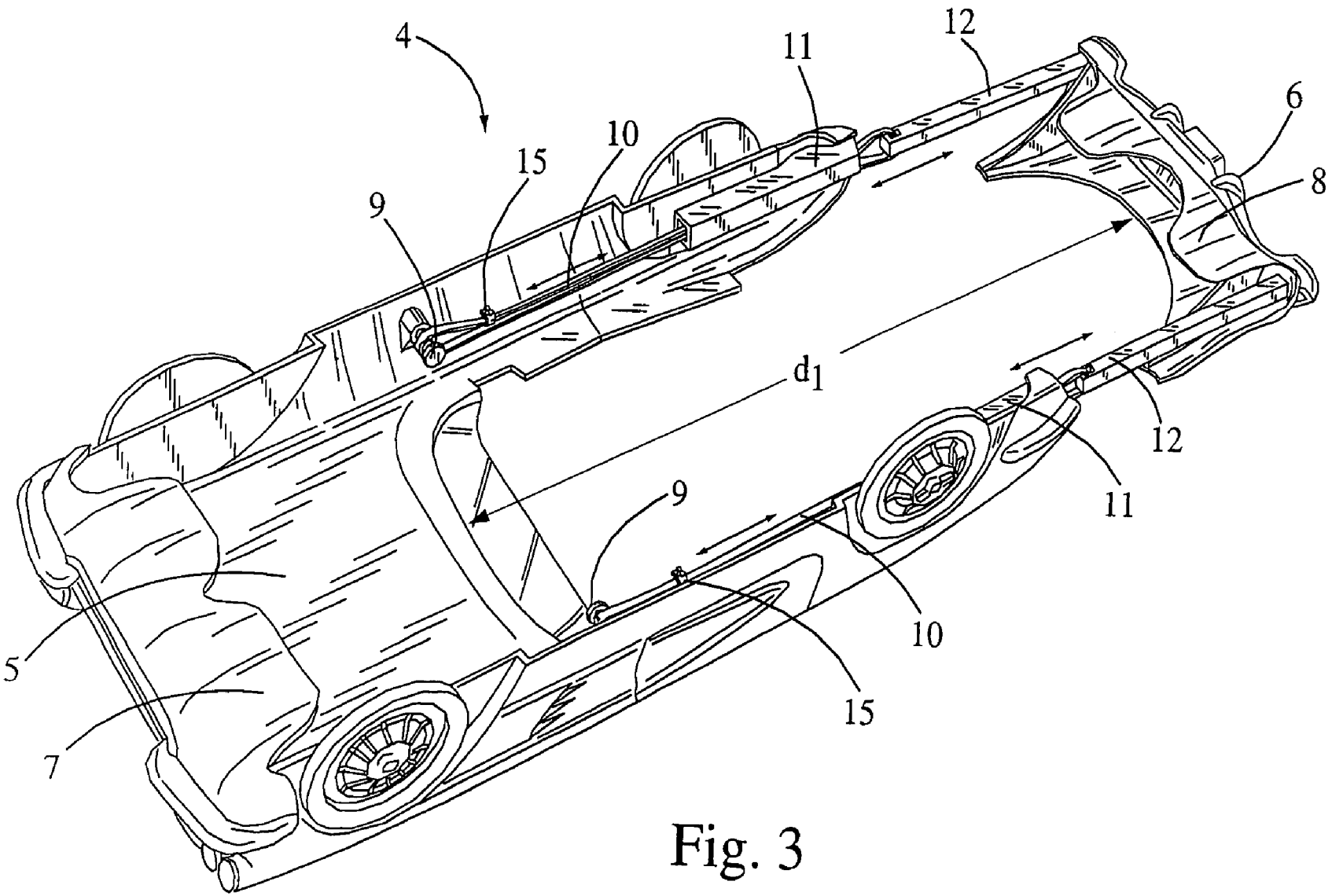
FIG. 3 is the same view as FIG. 2 with the parts assembled and mounted on a relatively large boot (not shown).

FIG. 3 shows the assembled skate car 4 with d1 enlarged to about the largest boot the unit could mount to. The posts 12 are just beyond the rear ends of the tubes 11. To enter the skate car 4 the skater takes off his skates and then pulls the front module 5 away from the rear module 6 so that the rubber bands 10 then pull the front and rear modules together. If the rubber bands 10 have a joint, it is shown as 15.

Figure 4:
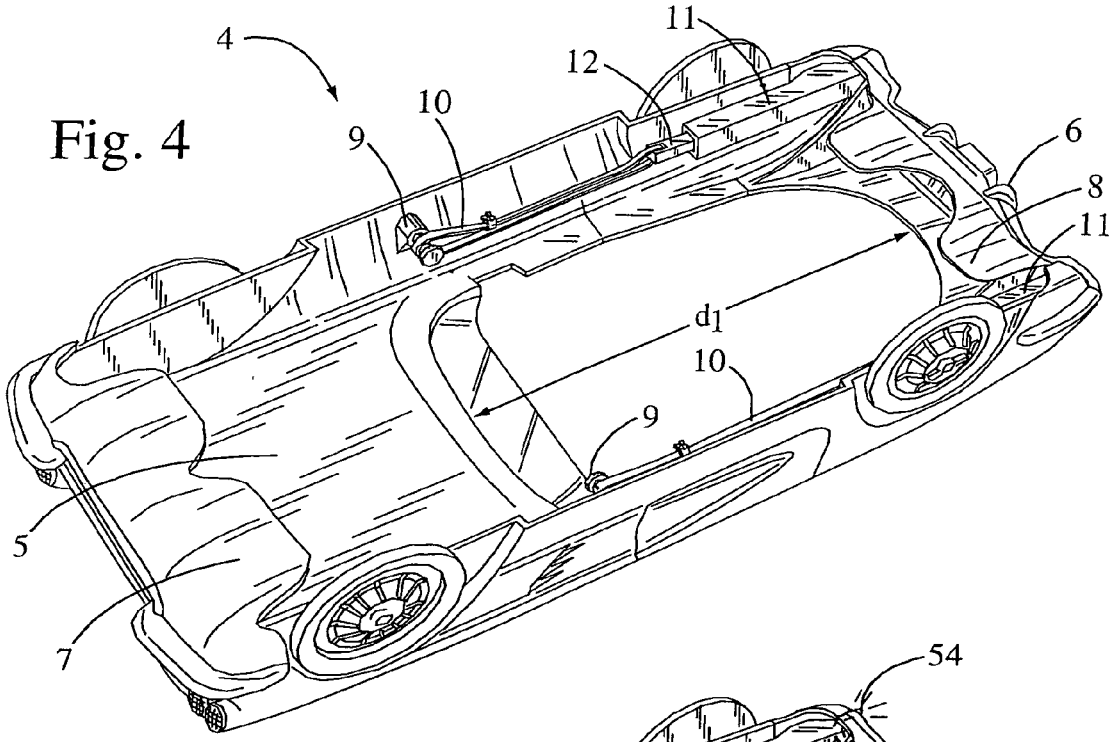
FIG. 4 is also a bottom perspective view of the preferred embodiment mounted on a relatively small boot (not shown).

FIG. 4 shows the skate car 14 in the fully closed position as shown mounted in FIG. 1, wherein d1 is at a minimum length. The rubber bands 10 have pulled the rods 12 all the way through tubes 11 until the rear module 6 engages the front module 5.

Figure 5:
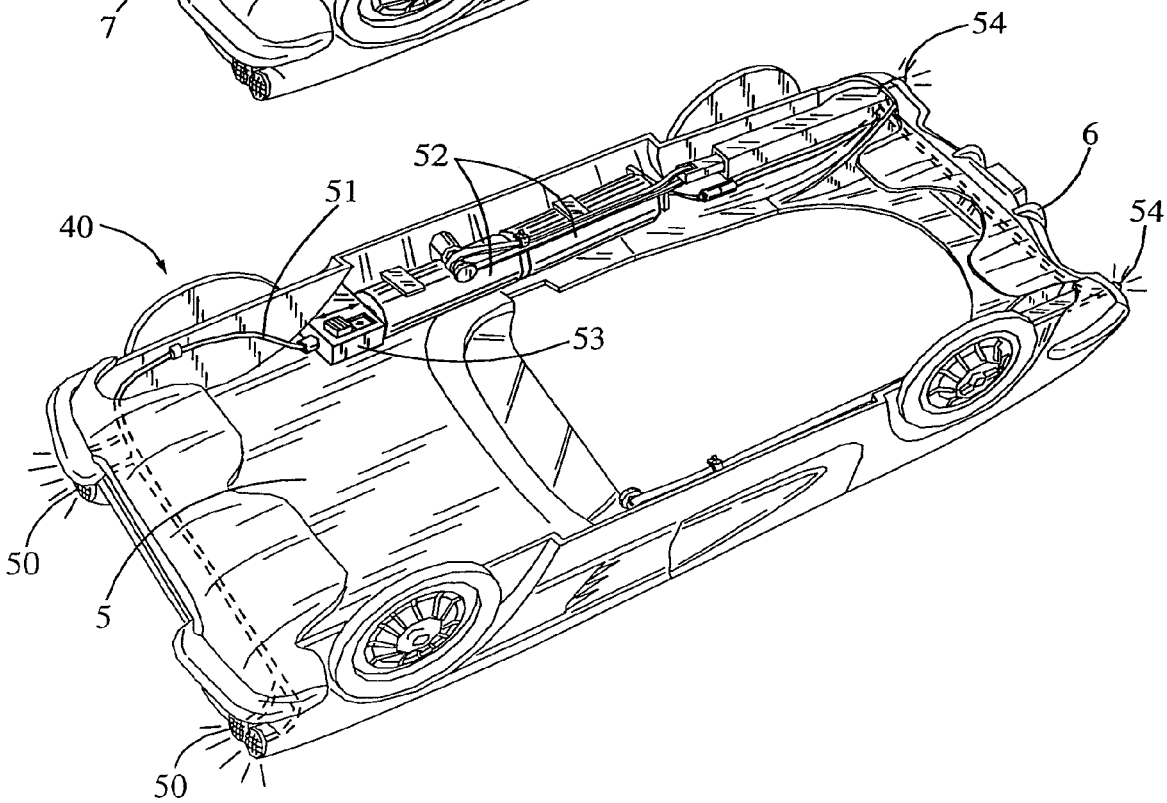
FIG. 5 is a bottom perspective view of a skate car having a battery and lights.

FIG. 5 shows a skate car 40 with two batteries 52 in series with a switch 53 and wires 51. Headlights 50 and taillights 54 may be continuous or flashing.

Figure 6:
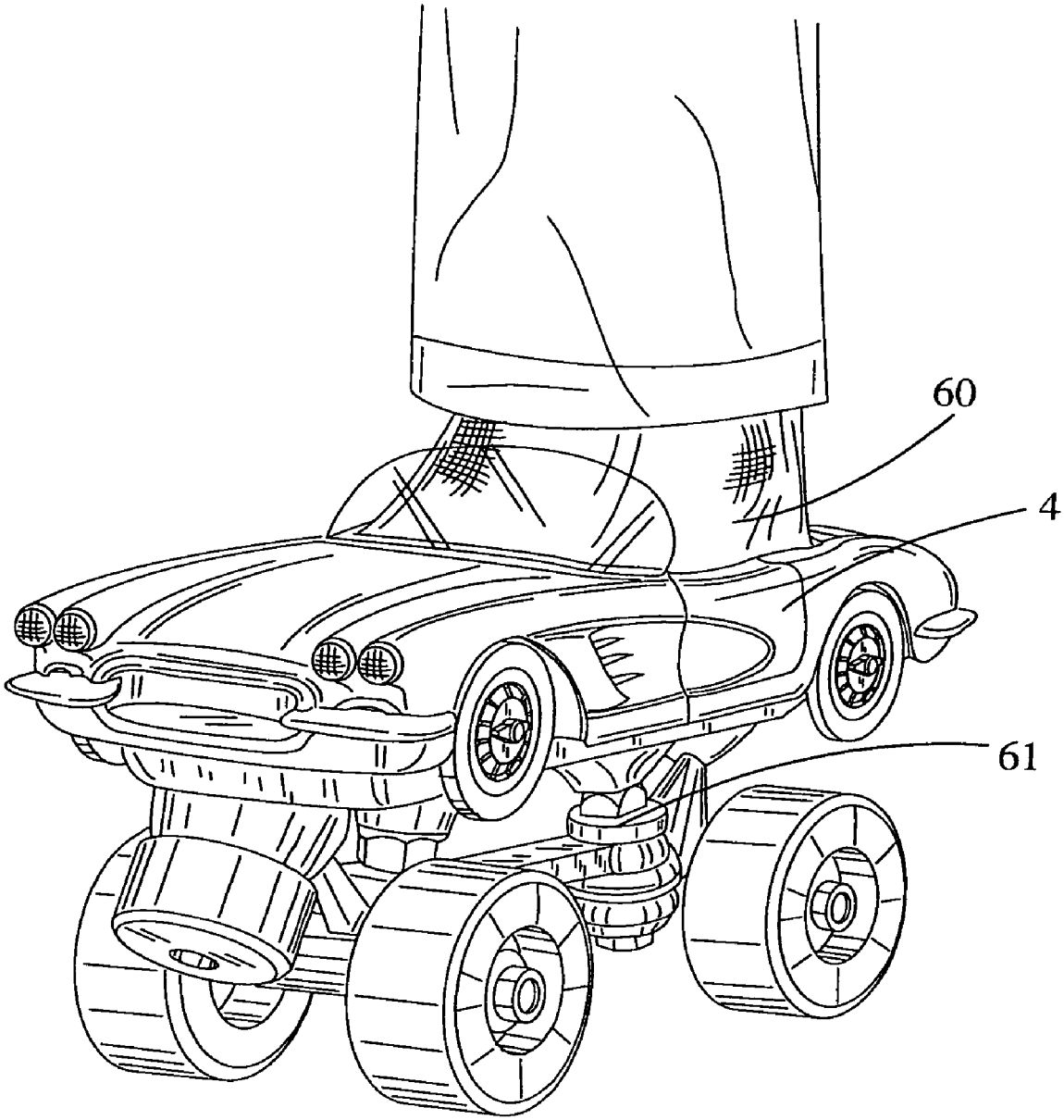
FIG. 6 is a side perspective view of a skate car mounted to a standard roller-skate.

FIG. 6 shows the same skate car 4 mounted on a boot 60 of standard roller-skate 61.

Figure 7:
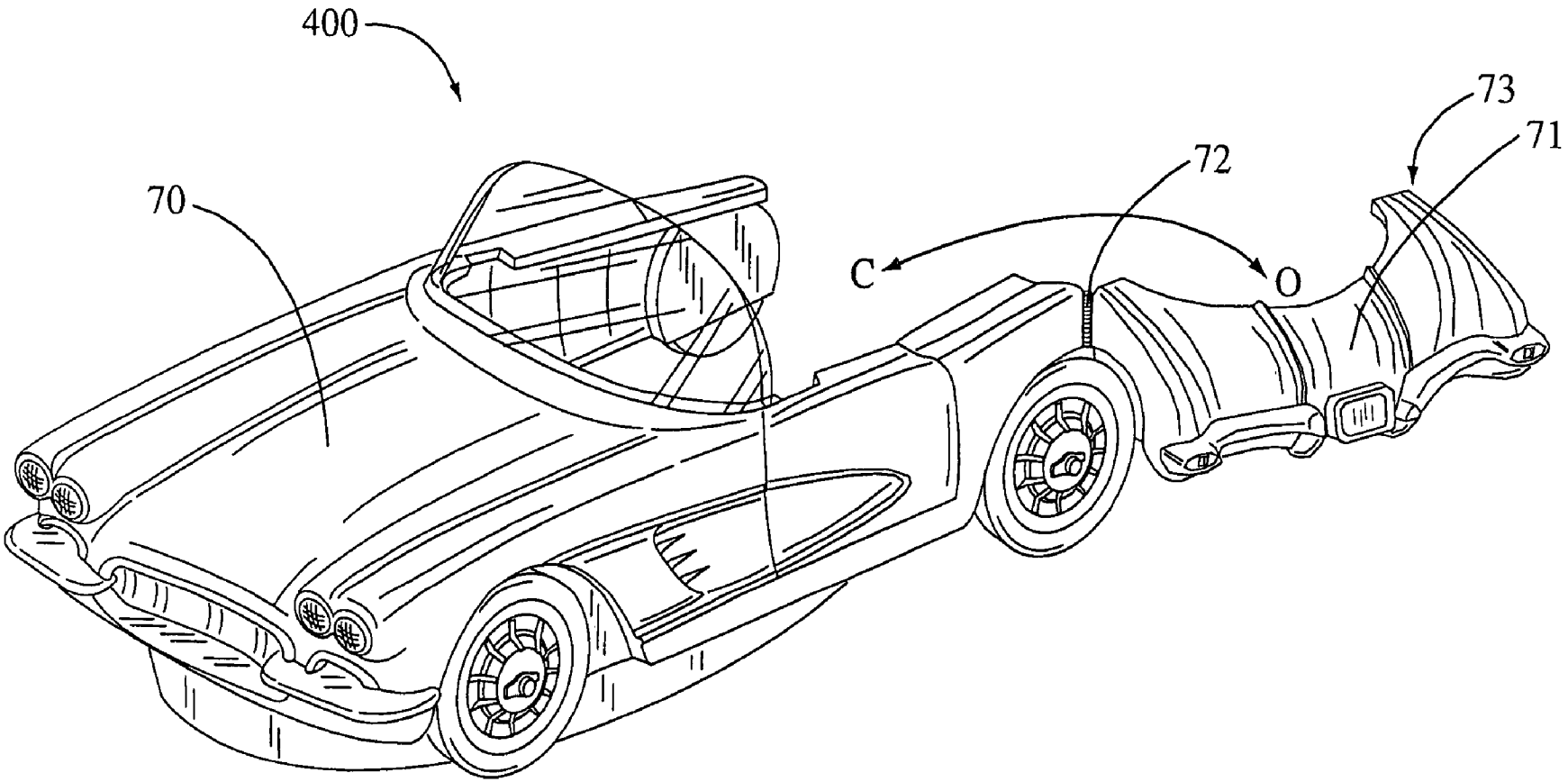
FIG. 7 is a top perspective view of an alternate embodiment skate car having a hinged rear bumper assembly.

FIG. 7 shows a one size only skate car 400, wherein the rear module 71 is either open O as shown, or closed C. The front module 70 is connected to the rear module 71 via hinge 72. A latch 73 (not shown) keeps the rear module 71 closed. This embodiment can be mounted on a skate without taking the skate off by simply mounting the front module 70 to the skate toe, and then closing the rear module 71.

Although the present invention has been described with reference to preferred embodiments, numerous modifications and variations can be made and still the result will come within the scope of the invention. No limitation with respect to the specific embodiments disclosed herein is intended or should be inferred. Each apparatus embodiment described herein has numerous equivalents.

The invention claimed is:

1. A skate attachment comprising:

a model car body sized to fit around a standard skate boot;

said model car body having a front end member with a mounting ping facing inbound from each of a left and a right side panel;

said left and right side panels each further comprising a guide tube each having a hollow interior channel running longitudinally relative to the model car body;

said model car body having a rear end member with a left end a right mounting rod, each rod sized to slide in the respective hollow interior channel;

wherein an elastic band connects each rod to its respective mounting pin; and wherein a range of skate boot sizes are accommodated by the elastic band pulling the front end member and the rear end member together around the skate boot.

2. The apparatus of claim 1, wherein the front end member further comprises all four wheels of the model car, and the rear end member further comprises a trunk section of the model car.

3. The apparatus of claim 1, wherein the model car body further comprises a battery and decorative lights.

4. The apparatus of claim 1, wherein the front end member when pulled against the rear end member provides a boot opening between the members.

5. The apparatus of claim 1, wherein each mounting rod is partially or fully engaged through the guide tube with each elastic band looped around each respective pin and connected to each respective rod.

6. The apparatus of claim 1, wherein each front end rear member has a ledge to fit under the skate boot.

7. A skate attachment comprising:

a model car body means functioning to provide a front end and a rear end of a model car sized to fit together around a skate boot and providing an opening between the front end and rear end for the boot; and a coupling means between the front end and the rear end functioning to pull the ends together around the skate boot, thereby accommodating a range of skate boot sizes.

8. The apparatus of claim 7 wherein the coupling means further comprises an elastic band connected from the front end to the rear end.

9. The apparatus of claim 7, wherein the model car body means further comprises a battery and a light.

10. The apparatus of claim 7 wherein the model car body means further comprises a ledge to fit under the skate boot.

11. The apparatus of claim 8, wherein the coupling means further comprises a post slidable in a guide.

12. A skate attachment comprising:

a model car body sized to fit around a standard skate boot;

said model car body having a front end member with a hinge connecting a rear end member;

wherein the rear end member can be closed around a heel of a skate after the front end member is placed around a toe segment of the skate; and wherein a latch keeps the rear end member closed.

13. The apparatus of claim 12, wherein the model car body further comprises a battery and a light.

14. The apparatus of claim 12, wherein the front end member further comprises four car wheels.

15. The apparatus of claim 12, wherein the model car body further comprises a ledge to fit under the skate.

* * * * *